US010354815B2

(12) United States Patent
Miyamoto

(10) Patent No.: US 10,354,815 B2
(45) Date of Patent: Jul. 16, 2019

(54) PUSH SWITCH

(71) Applicant: ALPS ALPINE CO., LTD., Tokyo (JP)

(72) Inventor: Junichi Miyamoto, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 15/935,552

(22) Filed: Mar. 26, 2018

(65) Prior Publication Data

US 2018/0218854 A1 Aug. 2, 2018

Related U.S. Application Data

(63) Continuation of application No. PCT/JP2016/078455, filed on Sep. 27, 2016.

(30) Foreign Application Priority Data

Oct. 13, 2015 (JP) ..... 2015-202362

(51) Int. Cl.
*H01H 13/48* (2006.01)
*H01H 13/04* (2006.01)
(Continued)

(52) U.S. Cl.
CPC ..... *H01H 13/04* (2013.01); *H01H 13/06* (2013.01); *H01H 13/48* (2013.01); *H01H 13/52* (2013.01);
(Continued)

(58) Field of Classification Search
CPC .. H01H 13/48; H01H 13/52; H01H 2215/004; H01H 2227/022;
(Continued)

(56) References Cited

U.S. PATENT DOCUMENTS 4,794,215 A * 12/1988 Sawada ..... H01H 13/06 200/302.2
5,199,555 A * 4/1993 Hirano ..... H01H 13/14 200/341
(Continued)

FOREIGN PATENT DOCUMENTS

JP 07-029728 U 6/1995
JP 09-148606 6/1997
(Continued)

OTHER PUBLICATIONS

International Search Report dated Nov. 1, 2016 in PCT/JP2016/078455 filed on Sep. 27, 2016.
(Continued)

*Primary Examiner* — Felix O Figueroa
(74) *Attorney, Agent, or Firm* — IPUSA, PLLC

(57) ABSTRACT

A push switch includes a base member including a depressed accommodating part, a fixed contact member provided and exposed in the accommodating part of the base member, a movable contact member installed in the accommodating part and including a dome part configured to be reversible to contact the fixed contact member, a sheet member installed to cover the accommodating part and hold the movable contact member, a pusher member installed between the top of the dome part and the sheet member, and a sheet-shaped reinforcing member formed of a material having a lower coefficient of thermal expansion than the sheet member. The reinforcing member is installed over the sheet member.

6 Claims, 8 Drawing Sheets

(51) Int. Cl.
*H01H 13/06* (2006.01)
*H01H 13/52* (2006.01)

(52) U.S. Cl.
CPC . *H01H 2215/004* (2013.01); *H01H 2223/044* (2013.01); *H01H 2227/022* (2013.01); *H01H 2227/026* (2013.01); *H01H 2239/036* (2013.01)

(58) Field of Classification Search
CPC ..... H01H 2227/026; H01H 2239/036; H01H 13/063; H01H 13/06
See application file for complete search history.

(56) References Cited

U.S. PATENT DOCUMENTS 5,664,667 A * 9/1997 Kenmochi ..... H01H 13/702 200/305
5,898,147 A * 4/1999 Domzalski ..... H01H 13/48 200/1 B
6,271,487 B1 * 8/2001 Domzalski ..... H01H 13/52 200/1 B
6,388,218 B1 * 5/2002 Ando ..... H01H 13/48 200/512
6,610,950 B1 * 8/2003 Kamio ..... H01H 13/48 200/406
7,109,431 B2 * 9/2006 Yanai ..... H01H 13/14 200/341
8,729,413 B2 5/2014 Nakaoka et al.
9,406,460 B2 * 8/2016 Nakaoka ..... H01H 13/14
2012/0055773 A1 3/2012 Nakaoka et al.
2013/0068599 A1 * 3/2013 Kikuchi ..... H01H 13/48 200/341
2013/0087443 A1 4/2013 Kikuchi

FOREIGN PATENT DOCUMENTS

JP 2008-250259 10/2008
JP 2010-135151 6/2010
JP 2011-040320 2/2011
JP 2012-059432 3/2012

OTHER PUBLICATIONS

Extended European Search Report for 16855257.8 dated Nov. 6, 2018.

* cited by examiner

PUSH SWITCH

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2016/078455, filed on Sep. 27, 2016 and designating the U.S., which claims priority to Japanese Patent Application No. 2015-202362, filed on Oct. 13, 2015. The entire contents of the foregoing applications are incorporated herein by reference.

BACK GROUND OF THE INVENTION

1. Field of the Invention

The present invention relates to push switches used for an input operation part of various kinds of electronic apparatuses.

2. Description of the Related Art

Recently, more and more keyboards for personal computers, etc., have adopted push switches that are independent key top by key top to improve the operation feeling of a key when the key is pushed. In the case of using a push switch, to ensure that the switch operates even when an operator's finger presses an edge of a key top, it is necessary to increase the contact area of the key top and the pusher member of the push switch. Therefore, there is a demand for an increase in the size (area) of the push switch.

Generally speaking, according to this type of push switch, a fixed contact member and an outside fixed contact member are provided at the inside bottom of a base member. The upper opening of the base member is covered with an insulating sheet member, and a dome-shaped movable contact member is accommodated in a space inside the base member covered with the sheet member. The outer peripheral edge of the movable contact member is in constant contact with the outside fixed contact member, and the center of the movable contact member is positioned above the fixed contact member in such a manner as to be able to come into and out of contact with the fixed contact member. External terminals are led out of the base member from the fixed contact member and the outside fixed contact member. The external terminals are soldered by reflow soldering to a circuit board on which this push switch is mounted.

As a push switch as described above, Japanese Laid-open Patent Publication No. 2012-059432 proposes a push switch 900 as illustrated in FIGS. 6 through 8. FIG. 6 is a sectional view of the push switch 900, which is a conventional example. FIG. 7 is a perspective view of the push switch 900. FIG. 8 is a perspective view of the push switch 900, illustrating generation of wrinkles WR in a protection sheet 940 of the push switch 900.

The push switch 900 has an appearance as illustrated in FIG. 7. As illustrated in FIG. 6, a movable contact 905 is placed in the accommodating part of a case 901, and the protection sheet 940 is attached to the case 901 through an adhesive layer 943 to cover the accommodating part. Furthermore, as illustrated in FIG. 6, the push switch 900 has a protrusion member 945 welded to the upper surface of the protection sheet 940 at a position corresponding to the center of the movable contact 905. The protrusion member 945 is exposed. That is, the protrusion member 945 itself is formed as a protrusion 950 of the push switch 900.

When an operator depresses the protrusion 950 of the push switch 900 from above, the center of the movable contact 905 is pressed in. Therefore, the center of the movable contact 905 reverses to contact a center contact 902. As a result, the center contact 902 and an outside contact 904 are electrically connected through the movable contact 905. Therefore, the switch operation changes from off to on. At this point, the reversal of the movable contact 905 generates a clicking sensation. Therefore, the operator can feel with a finger that the push switch 900 has turned on.

SUMMARY OF THE INVENTION

According to an aspect of the present invention, a push switch includes a base member including a depressed accommodating part, a fixed contact member provided and exposed in the accommodating part of the base member, a movable contact member installed in the accommodating part and including a dome part configured to be reversible to contact the fixed contact member, a sheet member installed to cover the accommodating part and hold the movable contact member, a pusher member installed between the top of the dome part and the sheet member, and a sheet-shaped reinforcing member formed of a material having a lower coefficient of thermal expansion than the sheet member. The reinforcing member is installed over the sheet member.

DETAILED DESCRIPTION OF THE PREFERRED EMBODIMENTS

Figure 8:
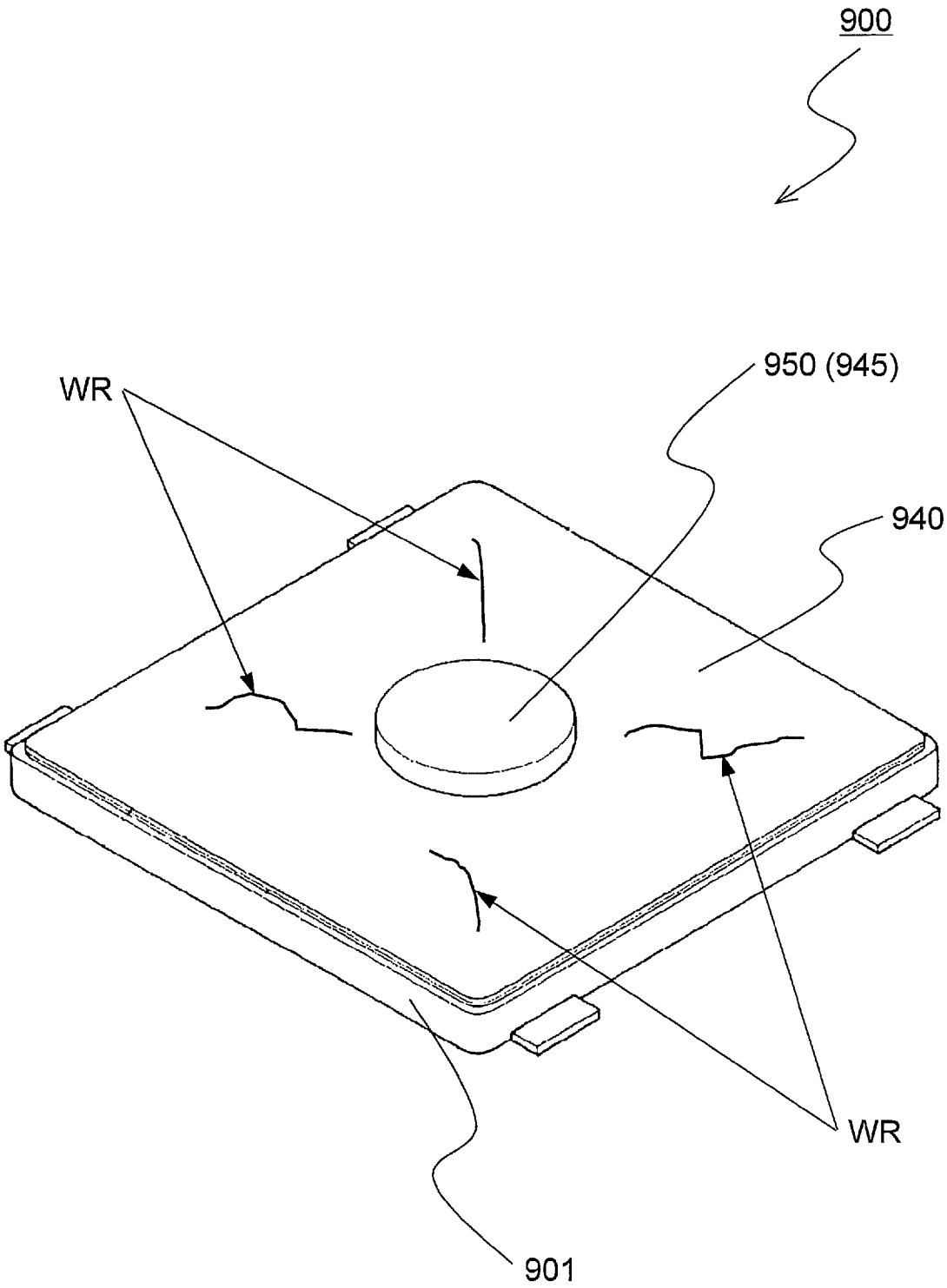
FIG. 8 is a perspective view illustrating generation of wrinkles in a protection sheet of the conventional push switch.

A new problem, however, has been found in that the wrinkles WR are generated in the protection sheet 940 in the conventional push switch 900 as illustrated in FIG. 8 when the push switch 900 is increased in area and is mounted on a circuit board by reflow soldering. These are generated by the thermal deformation of the protection sheet 940 due to its exposure to high temperatures (up to approximately 260° C.) during reflow soldering. There has been a problem in that changes in the shape of the wrinkles WR caused by the movement of the protection sheet 940 when the push switch 900 is operated may produce an abnormal sound.

According to an aspect of the present invention, a push switch in which an abnormal sound is less likely to be produced is provided.

A push switch according to an aspect of the present invention can reduce the production of an abnormal sound at the time of operation.

One or more embodiments of the present invention are described below with reference to the accompanying drawings.

First Embodiment

A push switch 100 according to a first embodiment of the present invention is described below using FIGS. 1 through 5.

Figure 1:
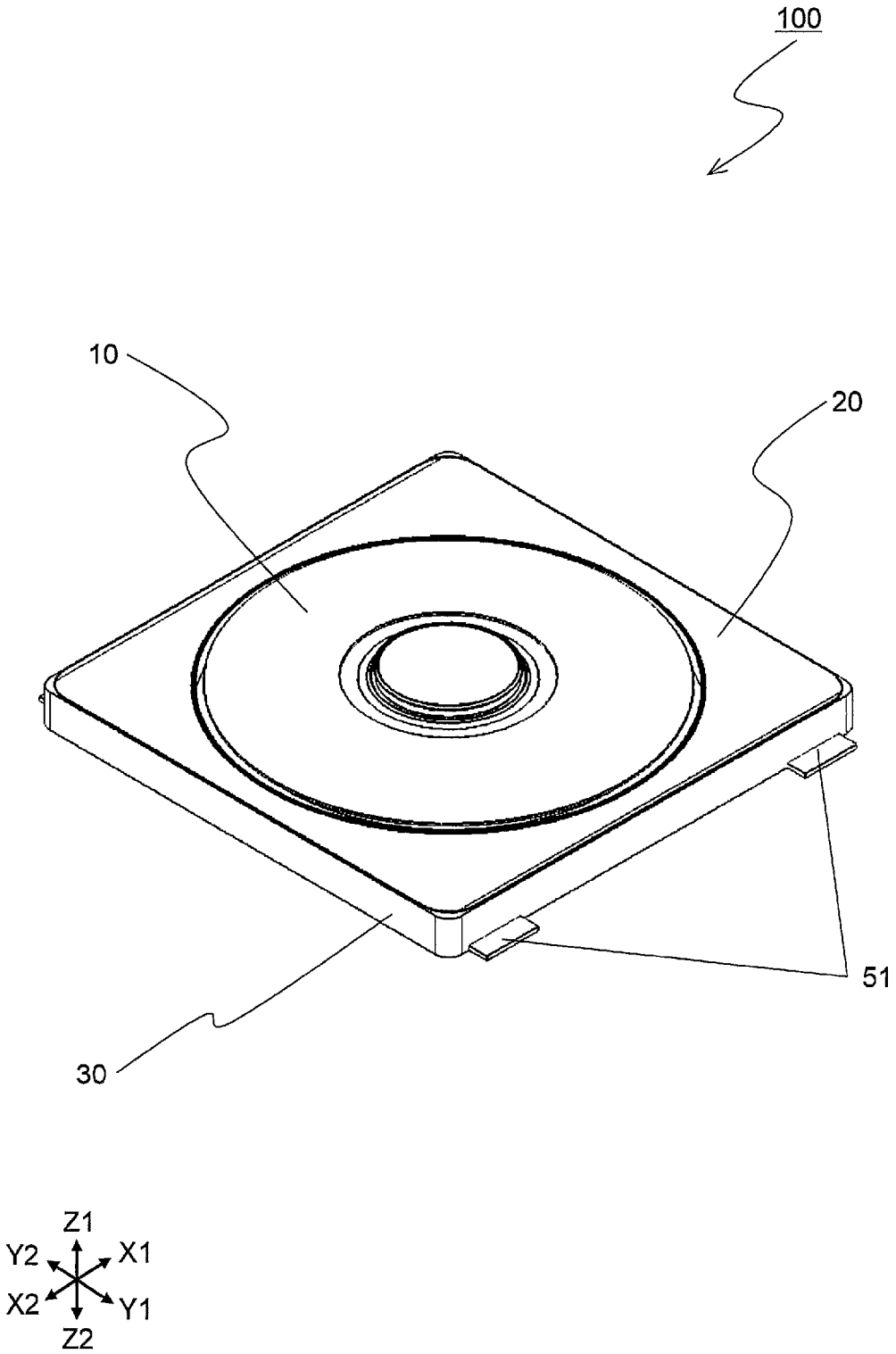
FIG. 1 is a perspective view illustrating an appearance of a push switch according to a first embodiment of the present invention.
Figure 2:
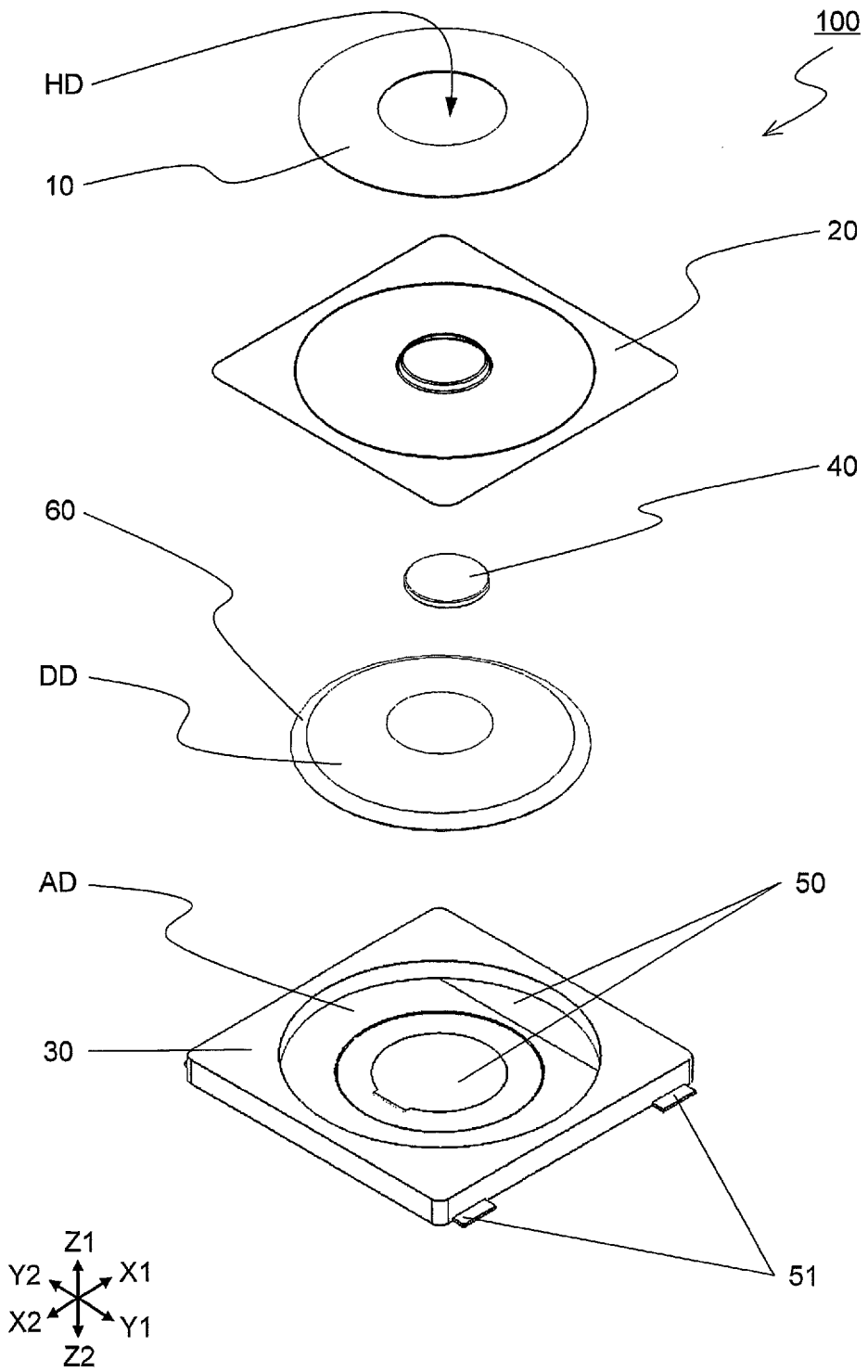
FIG. 2 is an exploded perspective view of the push switch according to the first embodiment of the present invention.
Figure 3:
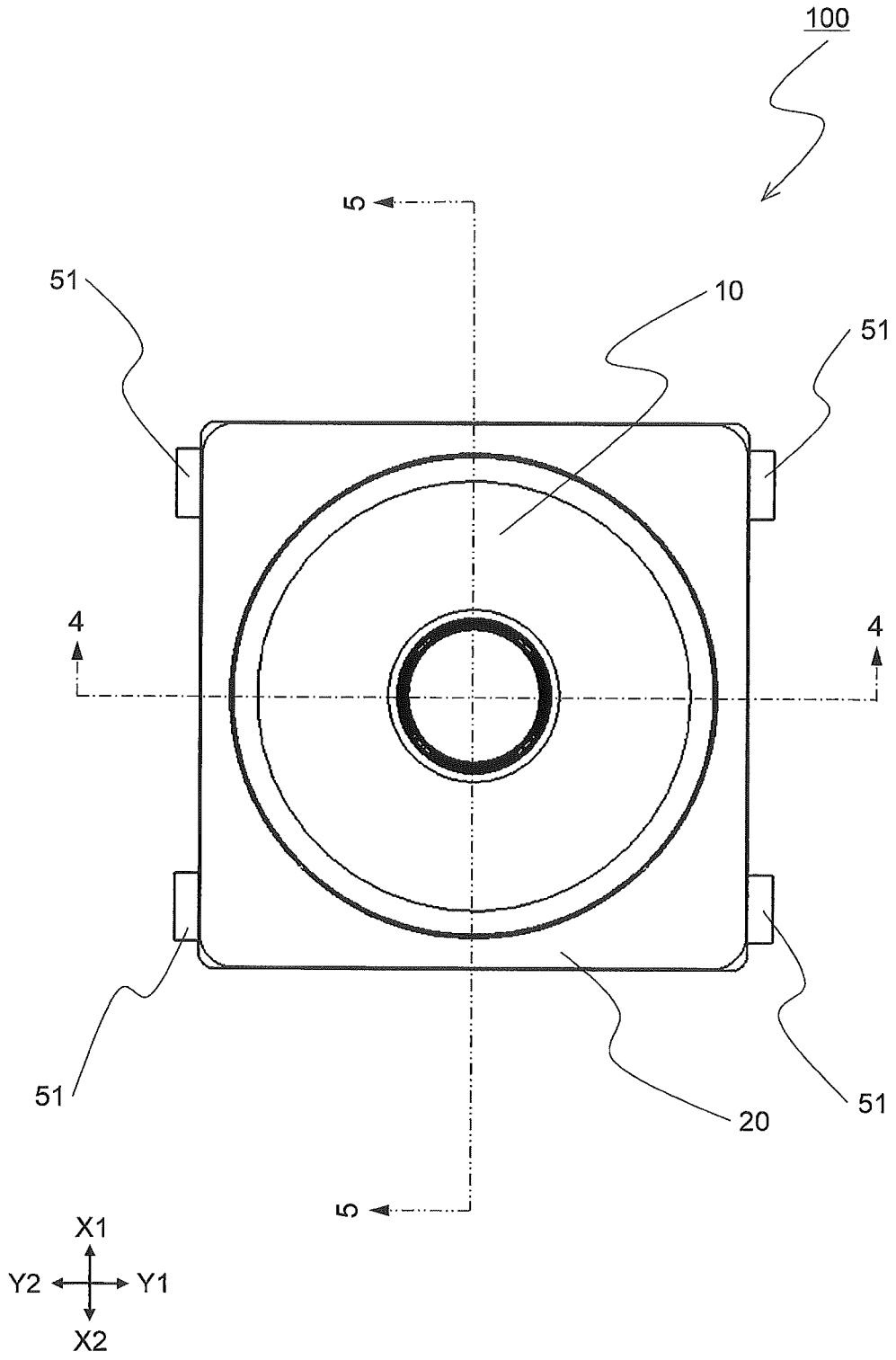
FIG. 3 is a plan view of the push switch according to the first embodiment of the present invention.
Figure 4:
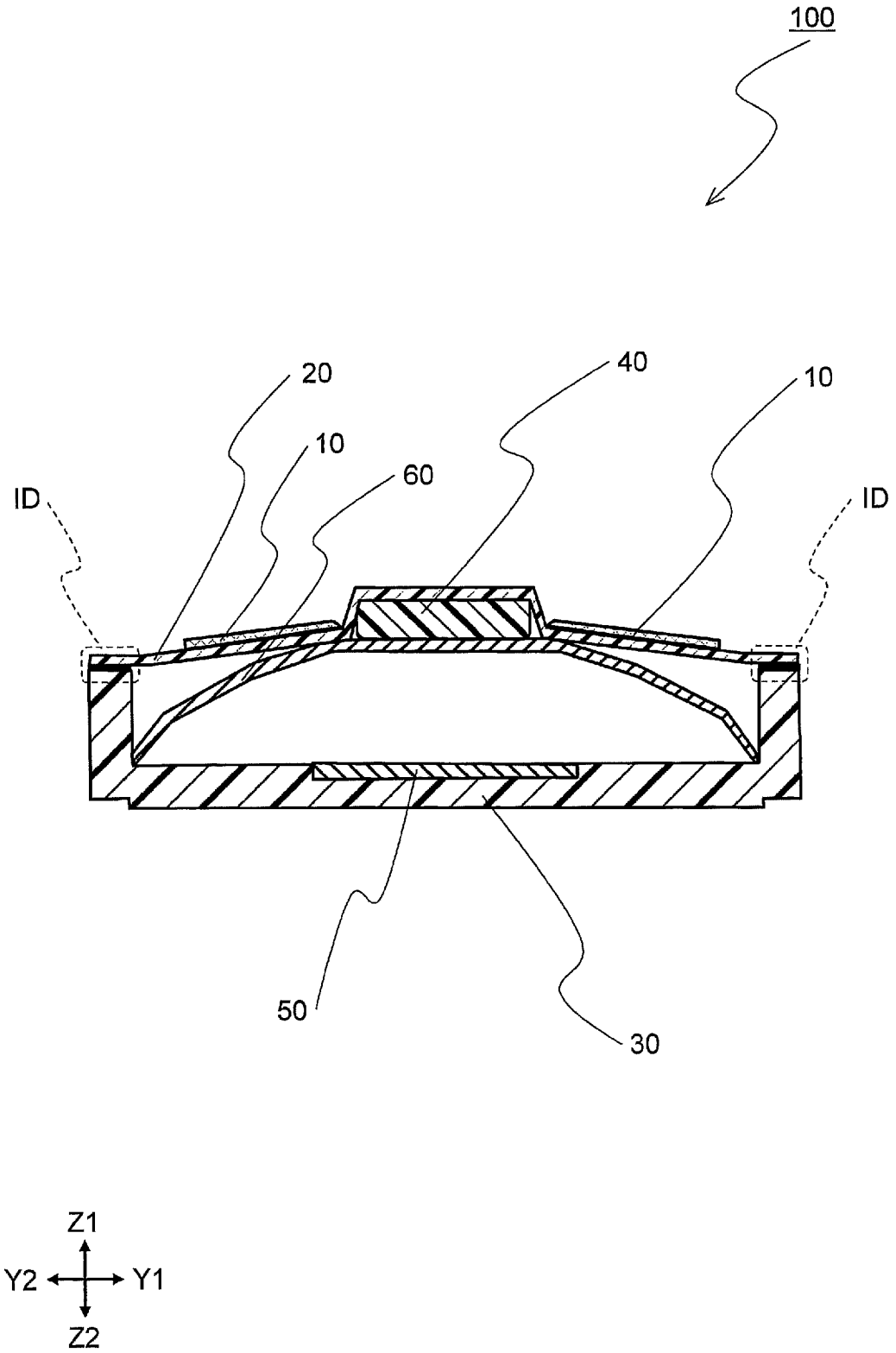
FIG. 4 is a sectional view taken along the line 4-4 of FIG. 3, illustrating the push switch according to the first embodiment of the present invention.
Figure 5:
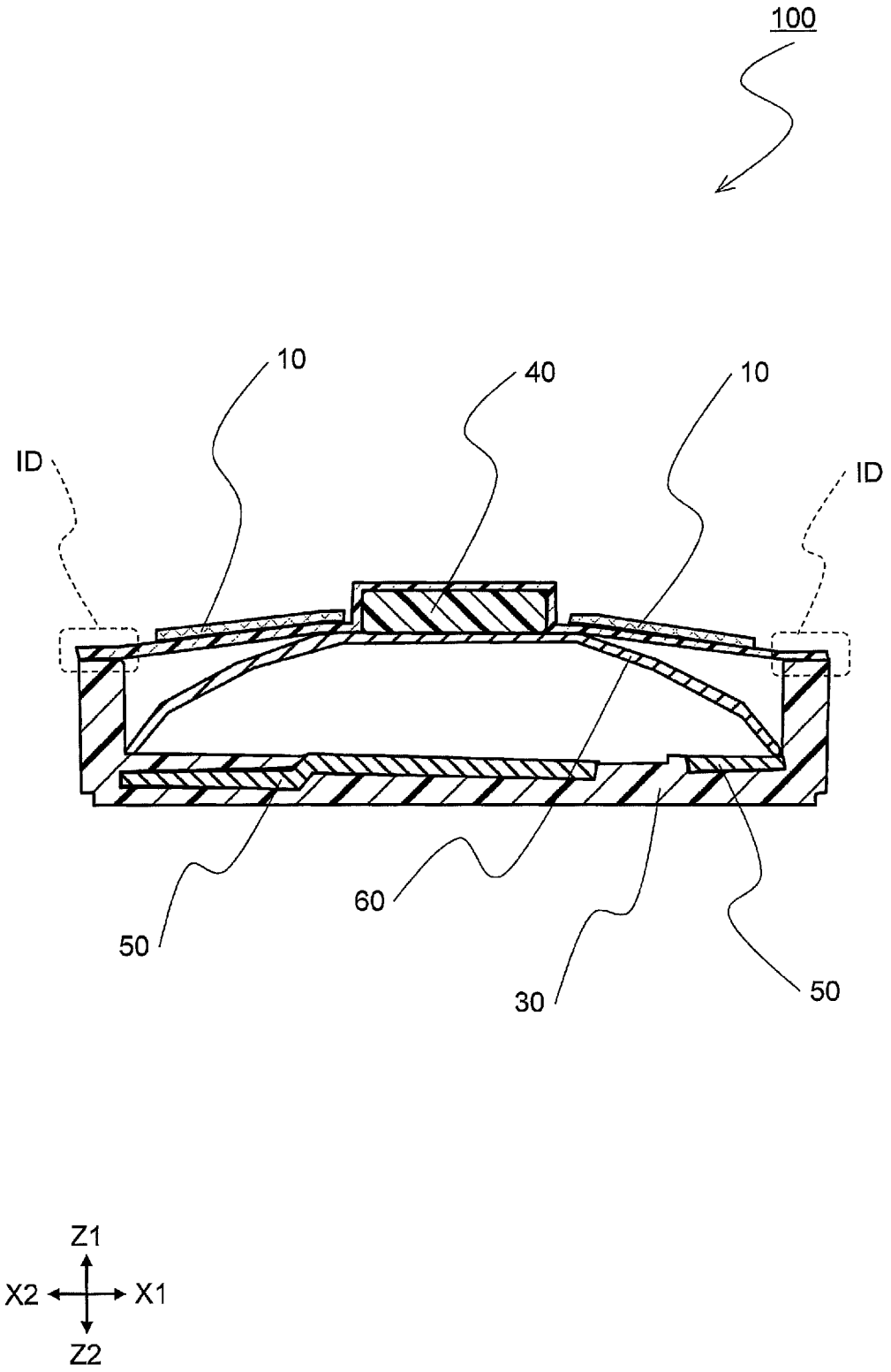
FIG. 5 is a sectional view taken along the line 5-5 of FIG. 3, illustrating the push switch according to the first embodiment of the present invention.
Figure 6:
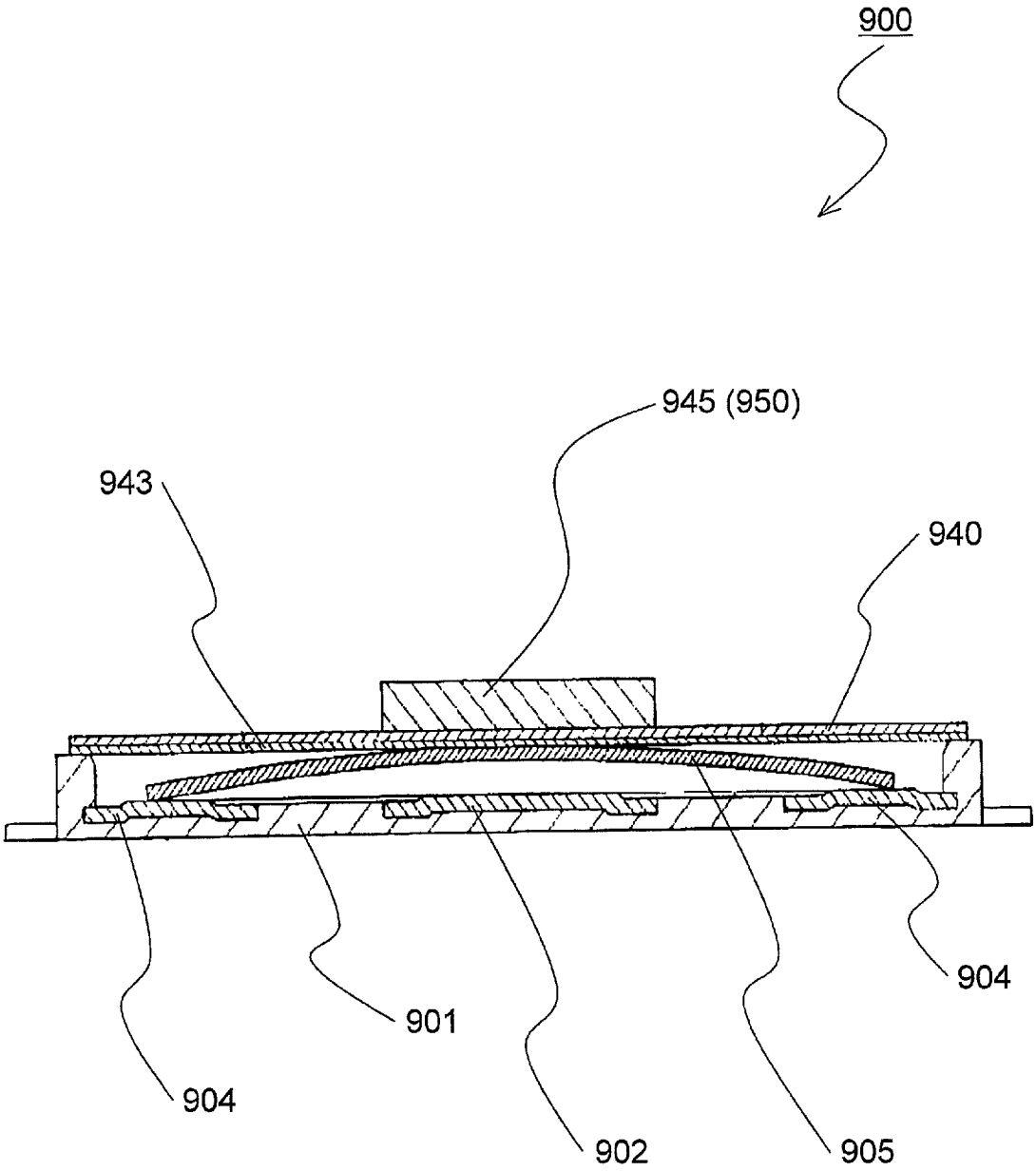
FIG. 6 is a sectional view of a conventional push switch.

FIG. 1 is a perspective view illustrating an appearance of the push switch 100 according to the first embodiment of the present invention. FIG. 2 is an exploded perspective view of the push switch 100. FIG. 3 is a plan view of the push switch 100. FIG. 4 is a sectional view taken along the line 4-4 of FIG. 3, illustrating the push switch 100. FIG. 5 is a sectional view taken along the line 5-5 of FIG. 3, illustrating the push switch 100.

As illustrated in FIG. 1, the push switch 100 of the first embodiment of the present invention has an appearance like a rectangular parallelepiped, and has a shape with a protruding center.

As illustrated in FIG. 2, the push switch 100 includes a base member 30 including a depressed accommodating part AD, fixed contact members 50 provided and exposed in the accommodating part AD of the base member 30, a movable contact member 60 installed in the accommodating part AD and including a reversible dome part DD that can contact the fixed contact member 50 placed in the center of the accommodating part AD, a sheet member 20 installed to cover the accommodating part AD and hold the movable contact member 60, a pusher member 40 installed between the top of the dome part DD and the sheet member 20, a sheet-shaped reinforcing member 10 formed of a material having a lower coefficient of thermal expansion than the sheet member 20, and external terminals 51 to be connected to patterns formed on a circuit board for mounting the push switch 100.

The base member 30 of the push switch 100, which is exposed in a high temperature environment of approximately 260° C. in a reflow soldering process when mounting the push switch 100 on a circuit board (not depicted), is formed unitarily with the fixed contact members 50 and the external terminals 51 by insert molding, using a polyamide (PA, POLYAMIDE) synthetic resin of high heat resistance (such as PA9T). Furthermore, a black or dark color synthetic resin is used for the base member 30.

As illustrated in FIG. 2, the base member 30 has a rectangular shape with the accommodating part AD, which is formed into a circular depression, provided in its center. Furthermore, the fixed contact members 50 and the external terminals 51 are formed unitarily with the base member 30. The fixed contact members 50 are installed to be exposed in the center of the accommodating part AD as illustrated in FIG. 2 and on one side of the accommodating part AD (in the X1 direction of FIG. 5) as illustrated in FIG. 5. The external terminals 51 are installed at the four corners of the base member 30 to protrude in the Y directions, and are formed into a rectangular plate shape. The fixed contact members 50 and the external terminals 51 are unitarily formed by stamping a highly-conductive, hoop-shaped copper-based (such as nickel silver or phosphor bronze) metal plate plated with gold, nickel, tin or the like.

As illustrated in FIG. 2, the fixed contact member 50 placed in the center of the accommodating part AD is processed into a disk shape, and is connected to the two external terminals 51 placed on the X2 direction side shown in FIG. 3. The fixed contact member 50 placed on the X1 direction side of the accommodating part AD is connected to the two external terminals 51 placed on the X1 direction side shown in FIG. 3. The two fixed contact members 50 are not electrically connected.

The external terminals 51 are connectable to patterns of a circuit board for mounting the push switch 100 by reflow soldering.

The movable contact member 60 of the push switch 100 is formed by processing a highly-conductive, hoop-shaped copper-based (such as nickel silver or phosphor bronze) metal plate plated with gold, nickel, tin or the like into a dome shape (the dome part DD) as illustrated in FIGS. 4 and 5. Furthermore, the top of the dome part DD of the movable contact member 60 is formed into a plane surface shape to make it possible to stably place the below-described pusher member 40 as illustrated in FIGS. 4 and 5.

As illustrated in FIG. 5, the outer peripheral edge of the movable contact member 60 is connected to the fixed contact member 50 placed on the X1 direction side of the accommodating part AD, and the dome part DD is positioned above the fixed contact member 50 placed in the center of the accommodating part AD to be able to come into and out of contact with the fixed contact member 50. Furthermore, the movable contact member 60 is configured to contact the fixed contact member 50. Therefore, the same metal material is used to ensure contact reliability because the potential gradient between different kinds of metal causes electrolytic corrosion.

As illustrated in FIGS. 2 and 3, a film sheet of a heat-resistant, transparent color or translucent color PA synthetic resin having a high laser light transmittance (such as PA9T) is used for the sheet member 20 of the push switch 100. The sheet member 20 is quadrangular, and has a cylindrically-formed center to be able to accommodate the below-described pusher member 40.

A second adhesive layer (not depicted) is formed on a surface (facing in the Z2 direction shown in FIG. 4) of the sheet member 20. The sheet member 20 is adhered to a surface of the below-described pusher member 40 and the dome part DD of the movable contact member 60 through this second adhesive layer.

As illustrated in FIGS. 4 and 5, the sheet member 20 is installed to cover the base member 30, and an interface part ID between the sheet member 20 and the base member 30 includes joined parts that are joined using laser welding. The sheet member 20 is provided to ensure protection of the contact members (the fixed contact members 50 and the movable contact member 60) of the push switch 100, the dustproof performance of the push switch 100, etc., and generally employs a material having the same coefficient of thermal expansion as the base member 30 to ensure the joining reliability of the interface part ID between the sheet member 20 and the base member 30.

The pusher member 40 of the push switch 100 is formed by injection molding, using a polyimide (PI, POLYIMIDE) synthetic resin having high strength and good electrical insulation. Furthermore, the pusher member 40 is cylindrically shaped as illustrated in FIG. 2, and is placed inside the cylindrically-formed center of the sheet member 20 as illustrated in FIGS. 4 and 5.

As illustrated in FIGS. 4 and 5, the pusher member 40 has an outer shape smaller than the outer shape of the dome part DD of the movable contact member 60, and is installed at and fixed by an adhesive agent or the like to the top of the dome part DD of the movable contact member 60. Therefore, the pusher member 40 is installed between the top of the dome part DD of the movable contact member 60 and the sheet member 20. The external dimensions of the pusher member 40 are smaller than the external dimensions of the movable contact member 60. Therefore, only the vicinity of the top of the movable contact member 60 is pressed in. Furthermore, the pusher member 40, which is adhered to the sheet member 20, does not come off the movable contact member 60 in spite of not being fixed thereto by an adhesive agent or the like. In this case, an assembly may be performed after adhering the pusher member 40 to the sheet member 20 in advance.

The reinforcing member 10 of the push switch 100 is formed by pressing a film sheet that uses a PEEK (POLYETHER ETHER KETONE) material that is a thermoplastic resin having a lower coefficient of thermal expansion than the sheet member 20. Furthermore, as illustrated in FIGS. 2 and 3, the reinforcing member 10 provides covering above the dome part DD and is annularly formed with a hole HD in a plan view. That is, the reinforcing member 10 is annularly formed with the hole HD to correspond to the outside of a region over the pusher member 40 within a region over the dome part DD in a plan view.

As illustrated in FIGS. 1 and 2, the reinforcing member 10 is annularly formed to surround the cylindrical pusher member 40 in a plan view. Furthermore, as illustrated in FIGS. 4 and 5, the reinforcing member 10 is superimposed on top of the sheet member 20. Furthermore, a first adhesive layer (not depicted) is formed on a surface (facing in the Z2 direction shown in FIG. 4) of the reinforcing member 10, and the reinforcing member 10 is adhered to the sheet member 20 through this first adhesive layer.

The reinforcing member 10 is formed so that its outer diameter is less than or equal to 150% of the diameter of the dome part DD, and the hole HD is formed so that its diameter is more than or equal to 100% of the diameter of the pusher member 40. That is, the reinforcing member 10 can cover the entirety of the sheet member 20 except for a region corresponding to the pusher member 40. According to this embodiment, the outer diameter of the reinforcing member 10 is set to be approximately 90% of the diameter of the dome part DD, and the diameter of the hole HD is set to be approximately 130% of the diameter of the pusher member 40. According to these settings, the reinforcing member 10 is adhered to the sheet member 20 between the joined part of the sheet member 20 and the pusher member 40.

The reinforcing member 10 having a lower coefficient of thermal expansion (a coefficient of thermal expansion=5[$\times 10^{-5}$/° C.]) is adhered to the sheet member 20 having a higher coefficient of thermal expansion (a coefficient of thermal expansion=8[$\times 10^{-5}$/° C.]). This reduces the thermal deformation of the sheet member 20 caused during the reflow soldering of the push switch 100. Furthermore, to reduce the thermal deformation of the sheet member 20, the width of the annular shape of the reinforcing member 10, namely, the width from the outer peripheral edge to the hole HD, is desirably more than or equal to 40% of the radius of the dome part DD, and is 50% according to this embodiment. Because of this setting, the reinforcing member 10 is installed on a large part of the region of the sheet member 20 between its joined part and the pusher member 40 where wrinkles are likely to be caused by thermal deformation, thus making it possible to reduce generation of wrinkles in the sheet member 20.

Figure 7:
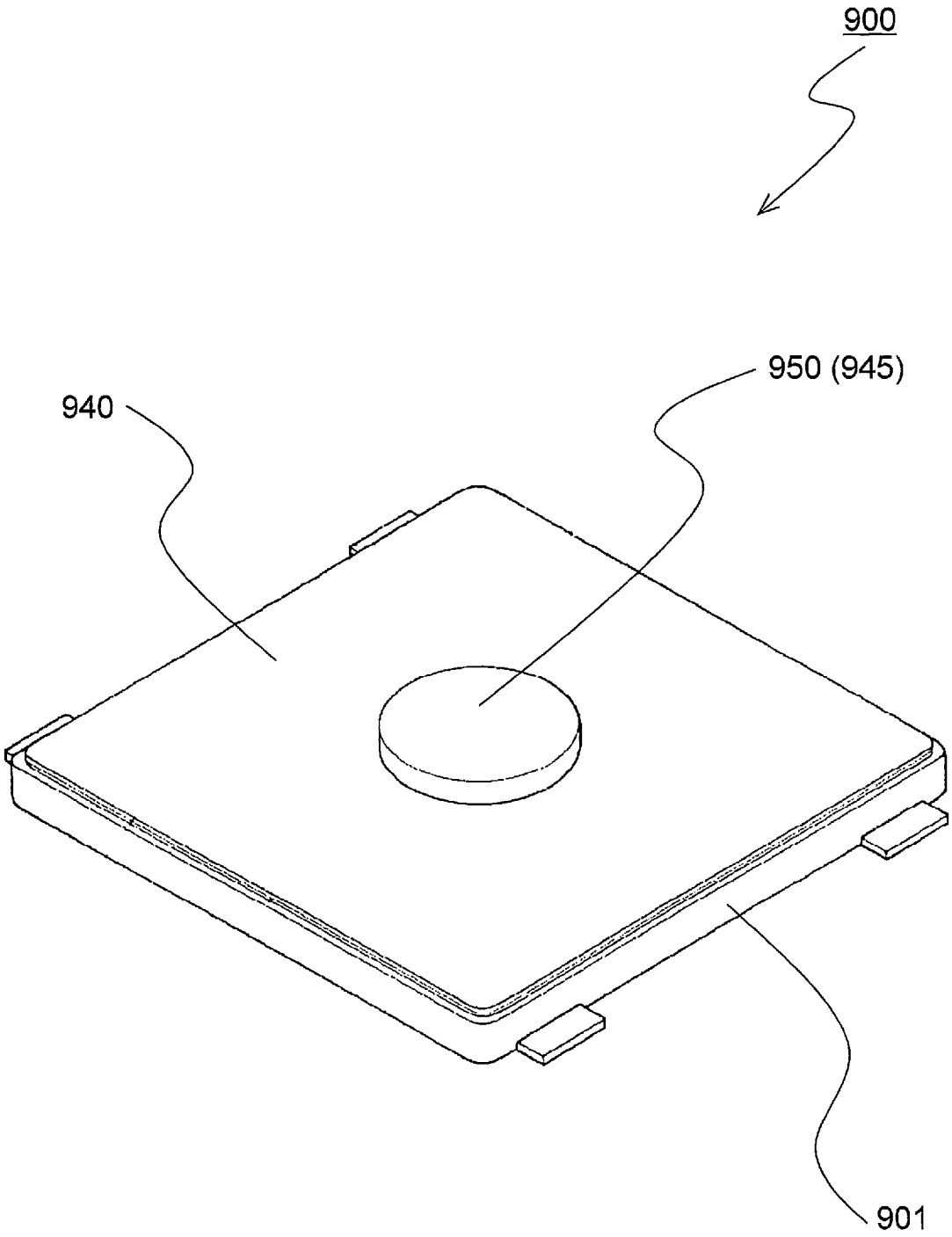
FIG. 7 is a sectional view of the conventional push switch.

Accordingly, while an increase in area for upsizing generates the wrinkles WR in the protection sheet 940 during reflow soldering as illustrated in FIG. 8 according to the conventional push switch 900 illustrated in FIG. 7, it is possible to reduce generation of wrinkles in the sheet member 20 (corresponding to the protection sheet 940 in FIG. 7) even when there is an increase in area according to the push switch 100 of this embodiment.

Here, an operation of the push switch 100 is briefly described.

A pressure-driven body such as an operation key top is installed over (in the Z1 direction shown in FIG. 1 from) the push switch 100 mounted on a circuit board, and when this pressure-driven body is depressed with an operator's finger, the dome part DD of the movable contact member 60 is pressed in through the sheet member 20 and the pusher member 40. Therefore, in response to a predetermined stroke to depress the pressure-driven body, the dome part DD of the movable contact member 60 reverses to contact the fixed contact member 50 placed in the center of the accommodating part AD.

As a result, the fixed contact members 50 and the movable contact member 60 are electrically connected. Therefore, an electrical signal due to the electrical connection is output from the external terminals 51 to change the switch operation from off to on. At this point, a clicking sensation is generated by the reversal of the movable contact member 60. Therefore, the operator who has depressed the operation key top can feel with the finger that the push switch 100 has turned on.

When the depression of the pressure-driven body is stopped, the reversed dome part DD of the movable contact member 60 restores itself to its original dome shape to return the switch operation to the initial off-state.

Effects of the push switch 100 of the first embodiment of the present invention as configured above are described together below.

The push switch 100 of the first embodiment of the present invention includes the sheet-shaped reinforcing member 10 formed of a material having a lower coefficient of thermal expansion than the sheet member 20, and the reinforcing member 10 is installed over the sheet member 20. Therefore, even when heat is applied during the mounting of the push switch 100 on a circuit board by reflow soldering, the reinforcing member 10 reduces the thermal deformation of the sheet member 20, and therefore, wrinkles are less likely to be generated in the sheet member 20. This makes it possible to reduce production of an abnormal sound due to wrinkles in the sheet member 20 when the push switch 100 is operated.

Furthermore, because the reinforcing member 10 has an annular shape with the hole HD, it is possible to oppose the pusher member 40 directly with the movable contact member 60. Thus, the reinforcing member 10 does not affect the depression of the pusher member 40, and it is possible to prevent the degradation of an operational feel when an operator depresses the push switch 100.

Furthermore, because the diameter of the hole HD is more than or equal to 100% of the diameter of the pusher member 40, the reinforcing member 10 avoids a region where the pusher member 40 protrudes. Therefore, when adhering the reinforcing member 10 to the sheet member 20, a gap, uplift or the like due to the interference of the reinforcing member 10 with the pusher member 40 is less likely to be caused between the reinforcing member 10 and the sheet member 20. Therefore, it is possible to reduce generation of wrinkles in the sheet member 20. In addition, because the outer diameter of the reinforcing member 10 is less than or equal to 150% of the diameter of the dome part DD, it is possible to ensure the adhesion area of the reinforcing member 10. This makes it possible to further reduce generation of wrinkles in the sheet member 20. These make it possible to more efficiently reduce generation of wrinkles in the sheet member 20 due to thermal deformation during the mounting of the push switch 100 on a circuit board by reflow soldering, and to prevent the degradation of the operational feel of the push switch 100.

Furthermore, because the reinforcing member 10 is installed on top of (in the Z1 direction shown in FIG. 4 from) the sheet member 20, the push switch 100 has good assemblability.

The push switch 100 according to an embodiment of the present invention is thus specifically described. The present invention, however, is not limited to the above-described embodiment, and can be practiced with various modifications without departing from the scope of the present invention. For example, the present invention can be practiced in the following variations, which also belong to the technical scope of the present invention.

[First Variation]

The push switch 100, which is described as a vertically depressible type in the first embodiment, may alternatively be a laterally operable side-push type.

[Second Variation]

The external terminals 51, which are plated in the first embodiment, may be plated with solder to improve solderability with patterns of a circuit board.

Third Embodiment

The reinforcing member 10 and the sheet member 20, which are separately prepared in the first embodiment, may alternatively be formed together as one piece by two-color injection molding and connected to the base member 30 by laser welding to cover the movable contact member 60.

According to an embodiment of the present invention, a push switch includes a base member including a depressed accommodating part, a fixed contact member provided and exposed in the accommodating part of the base member, a movable contact member installed in the accommodating part and including a dome part configured to be reversible to contact the fixed contact member, a sheet member installed to cover the accommodating part and hold the movable contact member, a pusher member installed between the top of the dome part and the sheet member, and a sheet-shaped reinforcing member formed of a material having a lower coefficient of thermal expansion than the sheet member. The reinforcing member is installed over the sheet member.

According to this, the push switch of the present invention includes a sheet-shaped reinforcing member formed of a material having a lower coefficient of thermal expansion than a sheet member, and the reinforcing member is installed over the sheet member. Therefore, even when heat is applied during the mounting of the push switch on a circuit board by reflow soldering, the reinforcing member reduces the thermal deformation of the sheet member, and therefore, wrinkles are less likely to be generated in the sheet member. This makes it possible to reduce production of an abnormal sound due to wrinkles in the sheet member when the push switch is operated.

In the push switch, the reinforcing member may be installed over the sheet member at least between a part of the sheet member joined to the base member and the center of the sheet member where the pusher member is installed.

In this case, in the push switch, the reinforcing member is installed over the sheet member between the center and the interface part of the sheet member. Therefore, the reinforcing member does not affect the depression of the pusher member, and it is possible to prevent the degradation of an operational feel when an operator depresses the push switch.

Furthermore, the reinforcing member may have an annular shape, and the width of the annular shape may be more than or equal to 40% of the radius of the dome part.

In this case, in the push switch, the reinforcing member has an annular shape and the width of the annular shape is more than or equal to 40% of the radius of the dome part. Therefore, it is possible to ensure a sufficient area of adhesion to the sheet member.

In the push switch, the reinforcing member may have an annular shape having a hole at a position corresponding to the pusher member in a plan view.

In this case, in the push switch, the reinforcing member has an annular shape having a hole, and the hole corresponds to the position of the pusher member. Therefore, the reinforcing member does not affect the depression of the pusher member, and it is possible to prevent the degradation of an operational feel when an operator depresses the push switch.

In the push switch, the pusher member may be cylindrically formed, the reinforcing member may be annularly formed, the outer diameter of the reinforcing member may be less than or equal to 150% of the diameter of the dome part, and the diameter of the hole may be more than or equal to 100% of the diameter of the pusher member.

In this case, in the push switch, because the diameter of the hole is more than or equal to 100% of the diameter of the pusher member, the reinforcing member avoids a region where the pusher member protrudes. Therefore, when adhering the reinforcing member to the sheet member, a gap, uplift or the like due to the interference of the reinforcing member with the pusher member is less likely to be caused between the reinforcing member and the sheet member. Therefore, it is possible to reduce generation of wrinkles in the sheet member. In addition, because the outer diameter of the reinforcing member is less than or equal to 150% of the diameter of the dome part, it is possible to substantially cover the entirety of the sheet member to ensure the adhesion area of the reinforcing member. This makes it possible to further reduce generation of wrinkles in the sheet member. These make it possible to more efficiently reduce generation of wrinkles in the sheet member due to thermal deformation during the mounting of the push switch on a circuit board by reflow soldering, and to prevent the degradation of the operational feel of the push switch. Furthermore, because the reinforcing member is annularly formed, the reinforcing member is adhered equidistantly from the cylindrically shaped pusher member. Therefore, when pressed, the sheet member uniformly flexes, thus making it possible to prevent the degradation of the operational feel.

In the push switch, the reinforcing member may be installed on top of the sheet member.

In this case, in the push switch, the reinforcing member is installed on top of the sheet member. Therefore, there is no need to adhere the reinforcing member to the sheet member in advance, and the movable contact member, the pusher member, the sheet member, and the reinforcing member can be installed on a case member in this order. Thus, the push switch has good assemblability. At this point, adhering the pusher member to the movable contact member or the sheet member in advance eliminates the misalignment of the pusher member, thus improving the assemblability.

What is claimed is:

1. A push switch comprising:

a base member including a depressed accommodating part;

a fixed contact member provided and exposed in the accommodating part of the base member;

a movable contact member installed in the accommodating part and including a dome part configured to be reversible to contact the fixed contact member;

a sheet member installed to cover the accommodating part and hold the movable contact member;

a pusher member installed between a top of the dome part and the sheet member; and a sheet-shaped reinforcing member formed of a material having a lower coefficient of thermal expansion than the sheet member, the reinforcing member being installed over the sheet member, the reinforcing member having a circular ring shape in a plan view and being adhered to the sheet member through an adhesive layer.

2. The push switch as claimed in claim 1, wherein the reinforcing member is installed over the sheet member at least between a part of the sheet member joined to the base member and a center of the sheet member where the pusher member is installed.

3. The push switch as claimed in claim 2, wherein a width of the circular ring shape is more than or equal to 40% of a radius of the dome part.

4. The push switch as claimed in claim 1, wherein the reinforcing member has a hole at a position corresponding to the pusher member in a plan view.

5. The push switch as claimed in claim 4, wherein the pusher member is cylindrically formed, an outer diameter of the reinforcing member is less than or equal to 150% of a diameter of the dome part, and a diameter of the hole is more than or equal to 100% of a diameter of the pusher member.

6. The push switch as claimed in claim 1, wherein the reinforcing member is installed on top of the sheet member.

* * * * *